US009599428B2

(12) United States Patent
Trpkovski

(10) Patent No.: US 9,599,428 B2
(45) Date of Patent: Mar. 21, 2017

(54) BOW RELEASE AID

(71) Applicant: P.T. Archery LLC, Prairie Du Sac, WI (US)

(72) Inventor: Paul Trpkovski, Green Cove Springs, FL (US)

(73) Assignee: P.T. Archery LLC, Prairie Du Sac, WI (US)

( * ) Notice: Subject to any disclaimer, the term of this patent is extended or adjusted under 35 U.S.C. 154(b) by 0 days.

(21) Appl. No.: 14/983,047

(22) Filed: Dec. 29, 2015

(65) Prior Publication Data

US 2016/0195359 A1 Jul. 7, 2016

Related U.S. Application Data

(60) Provisional application No. 62/099,292, filed on Jan. 2, 2015.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS

| | | | | | |
|---|---|---|---|---|---|
| 4,232,649 | A * | 11/1980 | Allen | F41B 5/1469 | 124/35.2 |
| 5,070,854 | A * | 12/1991 | Peck | F41B 5/1469 | 124/31 |
| 5,263,466 | A * | 11/1993 | Peck | F41B 5/1469 | 124/35.2 |
| 5,653,214 | A * | 8/1997 | Lynn | F41B 5/1469 | 124/35.2 |
| 5,685,286 | A | 11/1997 | Summers | | |
| 5,694,915 | A | 12/1997 | Summers | | |
| 6,571,786 | B2 | 6/2003 | Summers et al. | | |
| 6,651,642 | B1 * | 11/2003 | Powers | F41B 5/1469 | 124/31 |
| 7,328,694 | B2 | 2/2008 | Edmonds et al. | | |
| 8,622,051 | B2 | 1/2014 | Summers et al. | | |
| 8,746,221 | B2 | 6/2014 | Rentz et al. | | |
| 2015/0153131 | A1 | 6/2015 | Trpkovski | | |

* cited by examiner

*Primary Examiner* — John Ricci
(74) *Attorney, Agent, or Firm* — Pauly, DeVries Smith & Deffner, LLC

(57) ABSTRACT

Embodiments include a release aid for an archery bow. In an embodiment, the release aid comprises a fixed end configured to be fixed relative to an archer; a grasping element configured to grasp and release a drawstring; and a trigger element disposed between the fixed end and the grasping element. The trigger element is linked to the grasping element. When the grasping element is retaining the drawstring and the trigger element is activated the grasping element releases the drawing. A distance between the trigger element and the grasping element is at least 3 cm and not more than 25 cm. Other embodiments are also included herein.

23 Claims, 10 Drawing Sheets

802
810
800A
800B
800C
800D
800E

BOW RELEASE AID

CLAIM OF PRIORITY

This application claims the benefit of U.S. Provisional Application No. 62/099,292, filed Jan. 2, 2015, the content of which is herein incorporated by reference in its entirety.

FIELD OF THE TECHNOLOGY

The present application relates to a release aid for a bow. More specifically, the present application relates to a bow release aid with an extension member.

BACKGROUND

Archery bows have been in existence in many forms for thousands of years. Many ancient bows were shot or drawn using the thumb of the archer or a pair of fingers to draw and release the drawstring of a bow. Today, bows come in many forms to include recurve and compound bows. Bows are drawn using either fingers or mechanical release aids. Mechanical release aids increase accuracy, reduce pressure on the archer's fingers and reduce the likelihood of an accidental release. Furthermore, mechanical releases can further increase the accuracy by being used with a D-loop or short string attached to the drawstring. A D-loop or short string also can reduce wear and tear on the drawstring.

SUMMARY

In an embodiment, a release aid for an archery bow is provided. The release aid can include a fixed end configured to be fixed relative to an archer; a grasping element configured to grasp and release a drawstring; and a trigger element disposed between the fixed end and the grasping element. The trigger element is linked to the grasping element, such that when the grasping element is retaining the drawstring and the trigger element is activated the grasping element releases the drawing. A distance between the trigger element and the grasping element is at least 3 cm (1.2 in) and not more than 25 cm (9.8 in).

In an embodiment, the release aid further comprises a first shaft extending from the trigger element to the grasping element.

In an embodiment, the first shaft is configured to be removed and replaced with a second shaft, wherein the second shaft has a different length from the first shaft.

In an embodiment, the fixed end is configured to be gripped by an archer's hand.

In an embodiment, the fixed end comprises a coupling element, wherein the coupling element is configured to couple the release aid to the archer.

In an embodiment, the coupling element is a strap.

In an embodiment, the trigger element is activated by an archer's thumb.

In an embodiment, the trigger element is activated by an archer's index finger or middle finger.

In an embodiment, a system of archery release aids is provided. The system can include a first release aid and a second release aid. The first release aid for an archery bow comprises a first fixed end configured to be fixed relative to the archer; a first grasping element configured to grasp and release a drawstring; and a first trigger element disposed between the first fixed end and the first grasping element. The first trigger element is linked to the first grasping element, such that when the first trigger element is activated the first grasping element releases the drawstring. The second release aid for an archery bow comprises a second fixed end configured to be fixed relative to the archer; a second grasping element configured to grasp and release a drawstring; and a second trigger element disposed between the second fixed end and the second grasping element. The second trigger element is linked to the second grasping element, such that when the second trigger element is activated the second grasping element releases the drawstring. The distance between the first trigger element and the first grasping element is at least 1 cm (0.4 in) longer than the distance between the second trigger element and the second grasping element.

In an embodiment, the first release aid is identical to the second release aid except that the distance between the first trigger element and the first grasping element is different than the distance between the second trigger element and the second grasping element.

In an embodiment, the distance between the first trigger element and the first grasping element and the distance between the second trigger element and the second grasping element are both at least 3 cm (1.2 in) and not greater than 25 cm (9.8 in).

In an embodiment, the first trigger element and the second trigger element are both configured to be activated by an archer's thumb.

In an embodiment, the first trigger element and the second trigger element are both configured to be activated by an archer's index finger or middle finger.

In an embodiment the system further comprises a third release aid. The third release aid comprises a third fixed end configured to be fixed relative to the archer; a third grasping element configured to grasp and release a drawstring; and a third trigger element disposed between the third fixed end and the third grasping element. The third trigger element is linked to the third grasping element, such that when the third trigger element is activated the third grasping element releases the drawstring. The distance between the second trigger element and the second grasping element is at least 1 cm (0.4 in) longer than the distance between the third trigger element and the third grasping element.

In an embodiment, the distance between the first trigger element and the first grasping element, the distance between the second trigger element and the second grasping element, and the distance between the third trigger element and the third grasping element are all at least 3 cm (1.2 in) and not greater than 25 cm (9.8 in).

In an embodiment, a method for selecting an archery release aid is provided. The method can include determining an archer's draw length; determining a selected bow's draw length; calculating a difference between the archer's draw length and the bow's draw length; and selecting a release aid from a plurality of release aids based on the difference between the archer's draw length and the bow's draw length; wherein the plurality of release aids includes two or more release aids; wherein each of the releases aids that are included in the plurality of release aids comprises a trigger element and a grasping element; wherein each of the release aids that are included in the plurality of release aids has a different length from the trigger element to the grasping element.

In an embodiment, each of the release aids included in the plurality of release aids are substantially identical except for the length from the trigger element to the grasping element.

In an embodiment, each release aid has a distance from its trigger element to its grasping element that differs from all of the other release aids by at least 1 cm (0.4 in).

In an embodiment, all of the release aids included in the plurality of release aids have a distance from the trigger to the grasping element of at least 3 cm (1.2 in) and not more than 25 cm (9.8 in).

In an embodiment, each trigger element for each of the release aids included in the plurality of release aids is configured to be activated by an archer's thumb, or each trigger element for each of the release aids included in the plurality of release aids is configured to be activated by an archer's index finger or middle finger.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope of the present application is defined by the appended claims and their legal equivalents.

BRIEF DESCRIPTION OF THE FIGURES

The technology may be more completely understood in connection with the following drawings, in which.

While the technology is susceptible to various modifications and alternative forms, specifics thereof have been shown by way of example and drawings, and will be described in detail. It should be understood, however, that the application is not limited to the particular embodiments described. On the contrary, the application is to cover modifications, equivalents, and alternatives falling within the spirit and scope of the technology.

DETAILED DESCRIPTION

The embodiments of the present technology described herein are not intended to be exhaustive or to limit the technology to the precise forms disclosed in the following detailed description. Rather, the embodiments are chosen and described so that others skilled in the art can appreciate and understand the principles and practices of the present technology.

All publications and patents mentioned herein are hereby incorporated by reference. The publications and patents disclosed herein are provided solely for their disclosure. Nothing herein is to be construed as an admission that the inventors are not entitled to antedate any publication and/or patent, including any publication and/or patent cited herein.

A release aid for an archery bow is described herein. The release aid can have a distance between a trigger element and a grasping element to allow an archer to use a bow with a shorter draw length than the archer's normal draw length. The release aid can compensate for the difference between the archer's draw length and the bow's draw length. As a result of the use of such a release aid, an archer has an opportunity to shoot a more compact bow than a bow with a draw length that matches the archer's normal draw length. Also described herein is a system of a plurality of release aids, where each of the release aids has a different length. An archer can select one of the release aids from the system to use. The archer can make the selection based on his draw length and the draw length of the bow he or she is using. Further, a method of selecting a release aid is described herein. The method can include selecting a release aid from a set or plurality of release aids, based on the difference between the draw length of the archer and the draw length of the bow that will be used.

Figure 1:
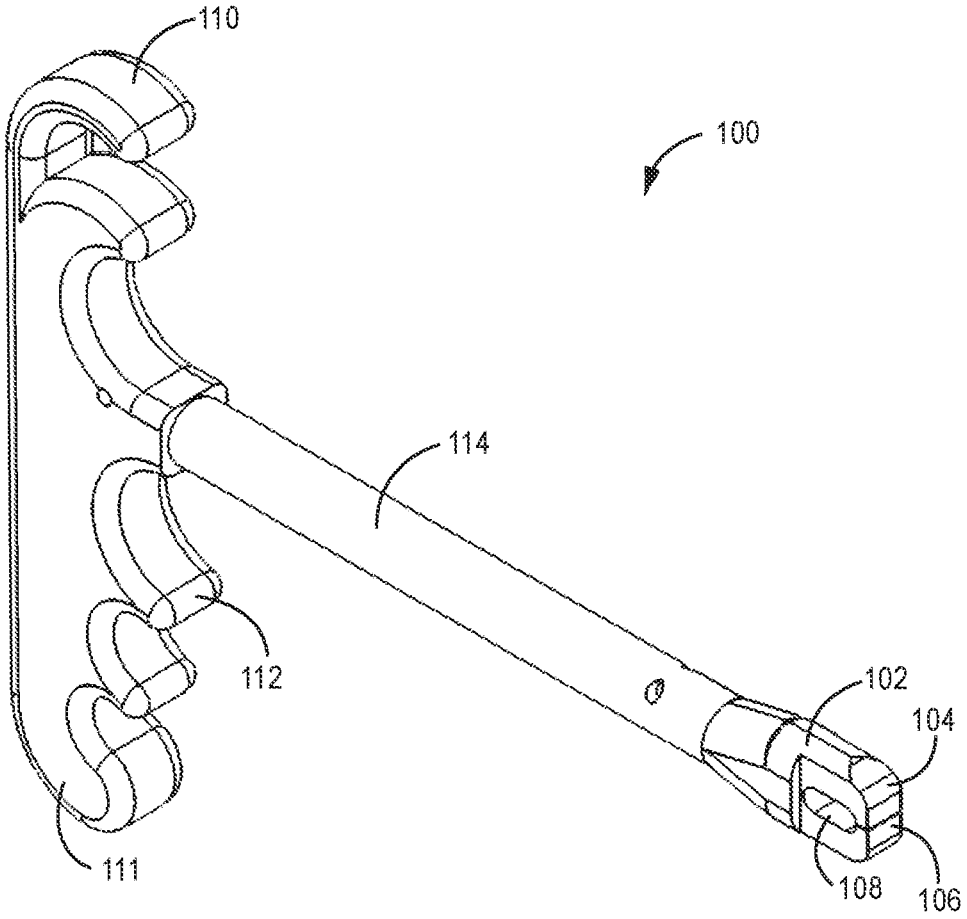
FIG. 1 is a perspective view of a release aid triggered with an archer's thumb, according to an embodiment.
Figure 2:
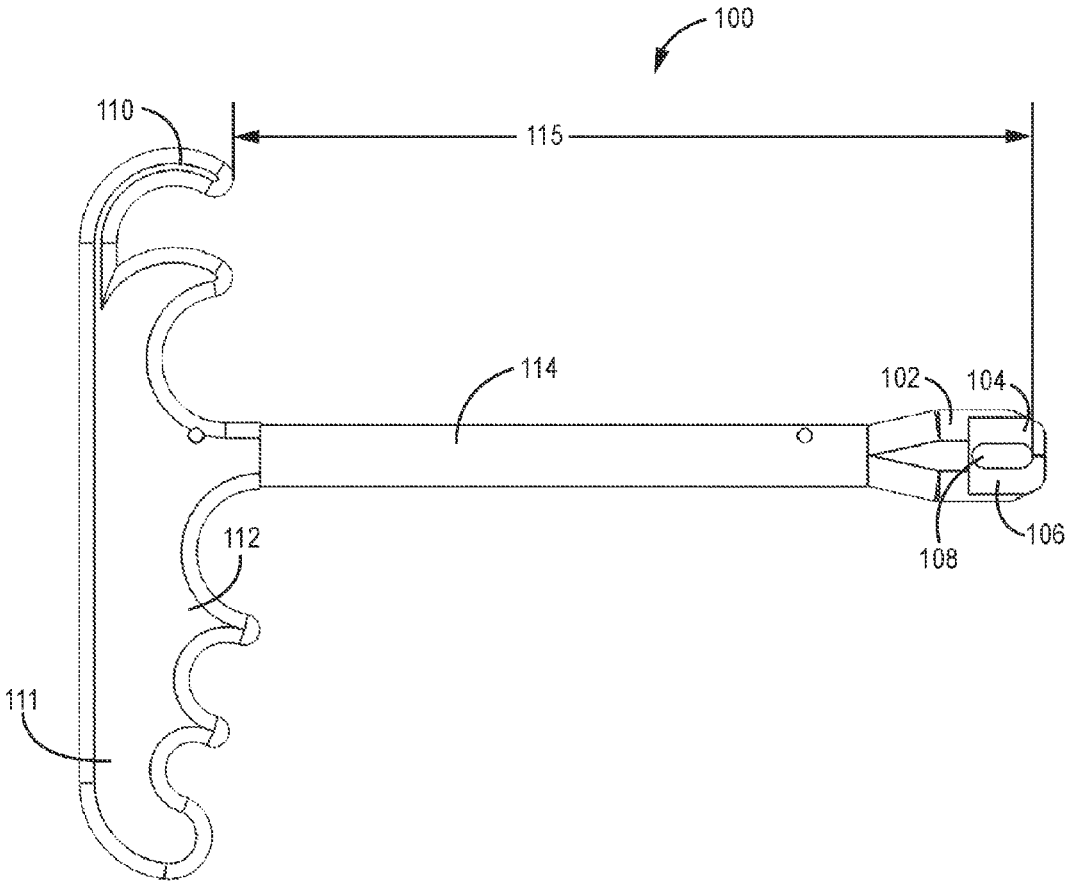
FIG. 2 is a front view of a release aid triggered with an archer's thumb, according to an embodiment.

FIG. 1 shows a perspective view of one example of a release aid 100 that is configured to be triggered with an archer's thumb, according to an embodiment. FIG. 2 shows a front view of the release aid 100.

The release aid 100 can be used by an archer to aid in drawing back the drawstring of a bow. The release aid 100 can include a grasping element 102 that is configured to grasp or hold a portion of a drawstring or a D-loop. Commonly owned and co-pending patent application Ser. No. 14/556,980, which was filed on Dec. 1, 2014, describes a compact bow of the type that could be used with the release aids described herein, the contents of which are herein incorporated by reference.

In various embodiments, the grasping element can include a caliper. A caliper can have two hinged legs or fingers. The grasping element can include two fingers 104, 106 that can open and close, such as to grasp or release the drawstring or a D-loop. The two fingers 104, 106 can define an aperture 108. The aperture 108 can be configured to enclose a portion of a drawstring or D-loop, such as while the grasping element is retaining a portion of the drawstring or D-loop. The two fingers 104, 106 can open or separate to release the drawstring or D-loop when the archer wants to shoot the bow, such as by pressing the trigger 110.

The release aid 100 can include a trigger 110. The trigger 110 can be configured to be pressed, pulled, pushed, or otherwise activated by the archer's thumb or finger. Activation of the trigger can result in the caliper or grasping element 102 opening, such as to accept or release the drawstring. The embodiment shown in FIGS. 1 and 2 is configured to be pressed by an archer's thumb. Upon pressing the trigger 110, the grasping element 102 can release the drawstring or D-loop, such as to shoot an arrow from the bow. Alternatively, upon activating the trigger 110, the grasping element 102 can open such as to accept a drawstring or D-loop within the aperture 108.

The release aid 100 can include a fixed end 111, such as a handle 112. The fixed end 111 can be fixed relative to the archer. The fixed end 111 can allow the release aid 100 to be attached to or coupled to the archer, such as by the archer holding the fixed end 111 or securing the fixed end 111 to the archer. The handle 112 can be configured to be held or gripped by the archer, such as while the archer is drawing, aiming or shooting the bow. In an embodiment, the trigger 110 can include a portion of the handle 112.

The release aid 100 can include an extension member 114. In some embodiments, the extension member 114 is adjustable, such that the length of the extension member 114 can be lengthened or shortened to meet the archer's requirements. The extension member 114 can increase the distance 115 between the trigger 110 and the grasping element 102. The trigger element 110 can include a surface for the archer's finger or thumb to apply pressure to when activating the trigger. The distance 115 can be measured from the most forward part (towards the grasping element 102) of the surface for the archer's finger or thumb to grasping element 102, specifically to where the drawstring is held by the grasping element, such as shown in FIG. 2. The extension member 114 can be adjustable, such as to vary the distance between the trigger 110 and the grasping element 102. Alternatively, different release aids 100 in a system can have extension members 114 of different lengths, such that an archer can select the release aid 100 with an extension member 114 of a desired length.

The release aid 100 can have a distance 115 between the trigger element 110 and the grasping element 102 of at least 3 cm (1.2 in) and not more than 25 cm (9.8 in). In an embodiment, the distance 115 is at least 4 cm (1.6 in) and not more than 21 cm (8.3 in). In an embodiment, the distance 115 is at least 5 cm (2 in) and not more than 20 cm (7.9 in).

In an embodiment, the distance 115 is at least 3 cm (1.2 in). In an embodiment, the distance 115 is at least 4 cm (1.6 in). In an embodiment, the distance 115 is at least 5 cm (2 in). In an embodiment, the distance 115 is at least 6 cm (2.4 in). In an embodiment, the distance 115 is at least 7 cm (2.8 in). In an embodiment, the distance 115 is at least 8 cm (3.1 in). In an embodiment, the distance 115 is at least 9 cm (3.5 in). In an embodiment, the distance 115 is at least 10 cm (3.9 in). In an embodiment, the distance 115 is at least 11 cm (4.3 in). In an embodiment, the distance 115 is at least 12 cm (4.7 in). In an embodiment, the distance 115 is at least 13 cm (5.1 in). In an embodiment, the distance 115 is at least 14 cm (5.5 in). In an embodiment, the distance 115 is at least 15 cm (5.9 in). In an embodiment, the distance 115 is at least 16 cm (6.3 in). In an embodiment, the distance 115 is at least 17 cm (6.7 in). In an embodiment, the distance 115 is at least 18 cm (7.1 in). In an embodiment, the distance 115 is at least 19 cm (7.5 in). In an embodiment, the distance 115 is at least 20 cm (7.9 in). In an embodiment, the distance 115 is at least 21 cm (8.3 in). In an embodiment, the distance 115 is at least 22 cm (8.7 in). In an embodiment, the distance 115 is at least 23 cm (9.1 in). In an embodiment, the distance 115 is at least 24 cm (9.4 in). In an embodiment, the distance 115 is at least 25 cm (9.8 in). The distance 315 shown in FIG. 4 can have the same possible lengths as distance 115.

The extension member 114 can extend from the fixed end 111 to the grasping element. The extension member 114 can extend from the trigger element to the grasping element. In an embodiment, the extension member 114 can be a shaft, such as a shaft with a circular cross-section. The extension member 114 can allow for an archer with a certain draw length to shoot a bow with a shorter draw length, enabling the archer to hold his arms in a fully drawn position. (In this application, a male pronoun will be used to refer to an archer because men typically have longer draw lengths and are more likely to benefit from a release aid as described herein, despite the fact that both men and women participate in archery and could benefit from such a release aid.)

Draw length for the bow refers to the distance that the notch in the arrow travels backwards when drawn prior to shooting. Compound bows are designed to be shot from a specific fully-drawn position and the draw length is determined by the mechanical systems, such as cams and pulleys, on the compound bow. Recurve bows can be drawn back to a variety of positions before shooting, so a range of draw lengths is possible for a particular recurve bow.

The draw length for an archer refers to the distance between the archer's drawing hand when fully drawn in a shooting position and where the drawstring is located at rest (or, prior to being drawn). A shooting position is where the archer's bow arm is grasping the bow and is extended toward a target, and the archer's drawing arm is grasping the drawstring and pulling the drawstring away from the bow with the drawing arm fully bent at the elbow.

For example, an archer might prefer to have a draw length of 34 inches (86.36 cm); however the bow the archer is using only has a draw length of 28 inches (71.12 cm). The extension member 114 can have a length of six inches (15.24 cm) to compensate for the difference between the archer's desired draw length and the bow's draw length.

In various embodiments, the distance between the trigger 110 and the grasping element 102 can be changed by removing the extension member 114 and replacing it with an extension member 114 of a different length. In an alternative embodiment, the distance between the trigger 110 and the grasping element 102 can be changed by adding or subtracting modules, such as lengthening members (as shown in FIGS. 6 and 7).

Figure 3:
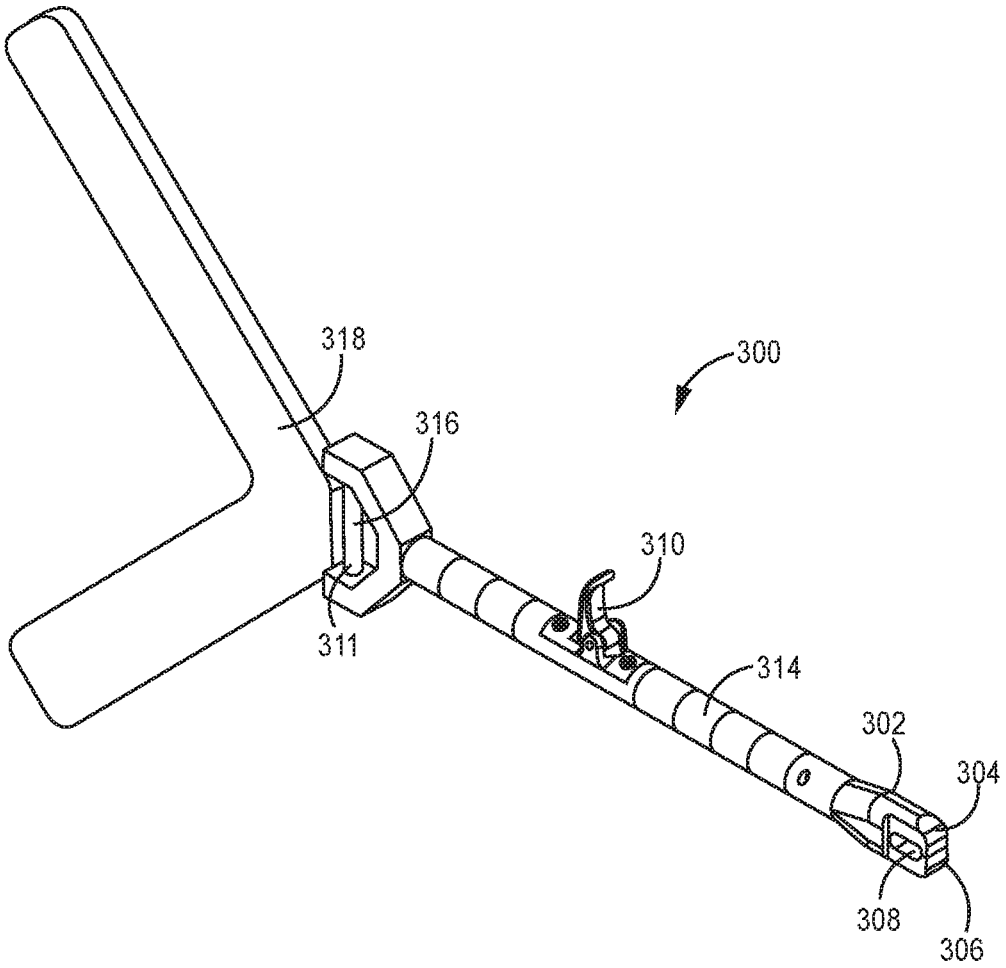
FIG. 3 is a perspective view of a release aid triggered with an archer's finger, according to an embodiment.
Figure 4:
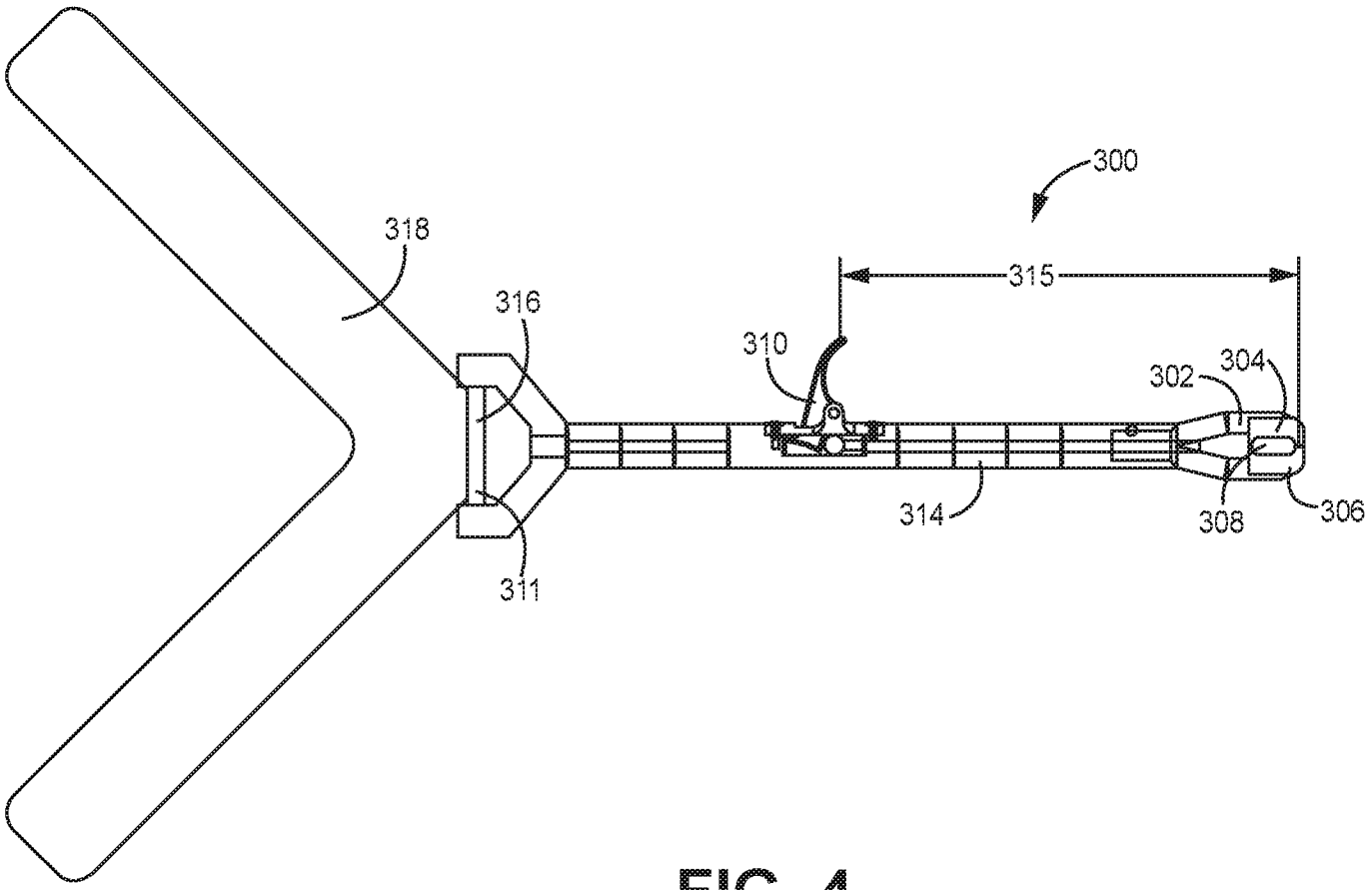
FIG. 4 is a front view of a release aid triggered with an archer's finger, according to an embodiment.
Figure 5:
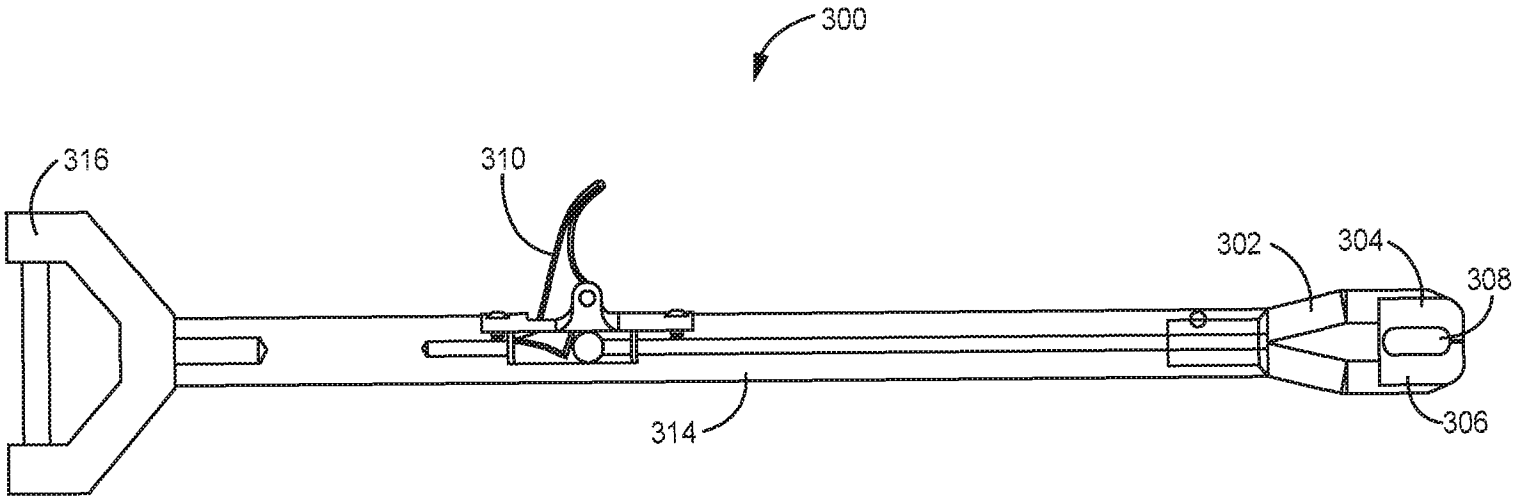
FIG. 5 is a front view of a release aid triggered with an archer's finger, according to an embodiment.

FIG. 3 shows a perspective view of a release aid 300 that is configured to be triggered with an archer's finger, according to an embodiment. FIG. 4 shows a front view of the release aid 300. FIG. 5 shows a front view of the release aid 300.

Similar to the grasping element discussed above, the release aid 300 can include a grasping element 302. The grasping element 302 can include two fingers 304, 306 that define an aperture 308. The release aid 300 can include an extension member 314. When a bow is used with a release aid 300, the combined apparatus has an effective draw length that is longer than the bow's draw length. As a result, the release aid/bow combination has an effective draw length that is longer than the draw length of the bow alone, so that the effective draw length can match the archer's draw length. The extension member 314 can increase the distance 315 between the trigger 310 and the grasping element 302.

The release aid 300 can include a trigger 310. The trigger 310 can be configured to be pressed, pulled, or pushed by the archer's finger, such as the index finger.

In various embodiments, the release aid 300 can include a coupling element, such as to couple or attach the release aid 300 to the archer. In some embodiments, the coupling element can include a strap 318. The release aid 300 can include a strap attachment element 316 configured to couple a strap 318 to the release aid 300. The strap attachment element 316 can include a post or bar, so that the strap 318 can be wrapped around the post or bar to couple the strap 318 to the release aid 300. The strap 318 can further be wrapped around or attached to the archer's hand, wrist, or arm, such as by using VELCRO® fastening fabric or another attachment mechanism on the strap. The coupling element can fix the fixed end 311 of the release aid 300 relative to the archer.

FIGS. 6A-H, 7A-H, and 8A-E, show various embodiments of systems of release aids. In various embodiments, a system can be provided which includes a plurality of release aids, such as shown in FIGS. 6A-H. The system can include a plurality of different release aids. In various embodiments, the release aids are of different lengths, such that an archer can select the release aid of the appropriate length to compensate between the difference in the archer's draw length and the bow's draw length.

In an alternative to showing a system of a plurality of release aids, FIGS. 6A-H can also show perspective views of a release aid 300 with increasing lengths of the extension member 314. FIGS. 7A-H are side views of the release aid 300 with increasing lengths of the extension member 314. The extension member 314 can include one or more lengthening members, such as a segment that is added to the extension member 314 between the grasping element 302 and the strap attachment element 316 (or handle) to increase the length of the extension member 314. The lengthening members can be coupled to each other, such as by male and female threaded connections.

In various embodiments, the lengthening members are all substantially the same length, such as 0.5 inches (1.27 cm), 1 centimeter or other lengths. In alternative embodiments, the lengthening members are different lengths. The lengthening members can be at least 0.25 inches (0.635 cm) in some examples. The lengthening members can be at most 8 inches (20.32 cm) in some examples. The lengthening members can range in length from 0.25 inches (0.635 cm) to 8 inches (20.32 cm) in some examples.

Figures 6A, 6B, 6C, 6D, 6E, 6F, 6G, 6H:
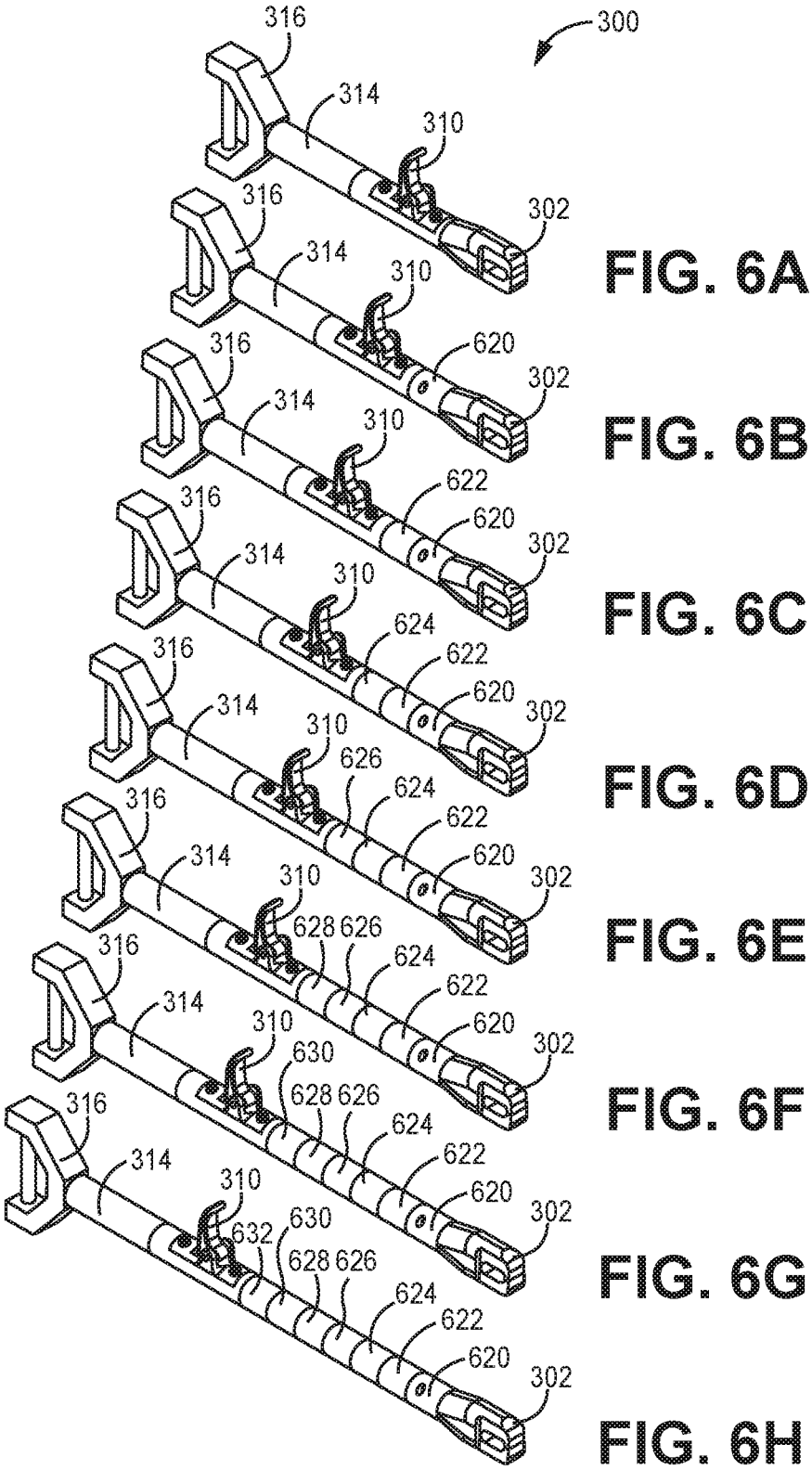
FIGS. 6A-H are perspective views of a release aid triggered with an archer's finger, according to an embodiment.
Figure 7A:
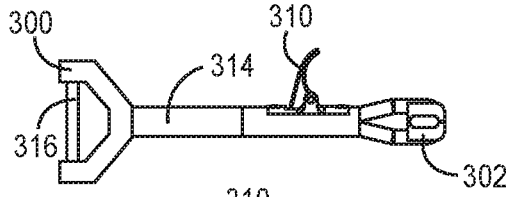
FIGS. 7A-H are side views of a release aid triggered with an archer's finger, according to an embodiment.

FIGS. 6A and 7A show a release aid 300 without any lengthening members.

Figure 7B:
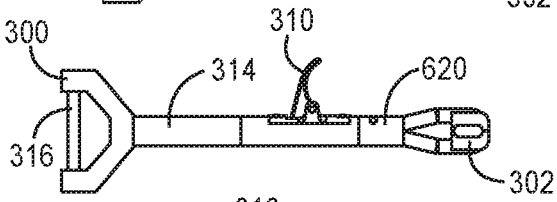

FIGS. 6B and 7B show a release aid 300 with a first lengthening member 620.

Figure 7C:
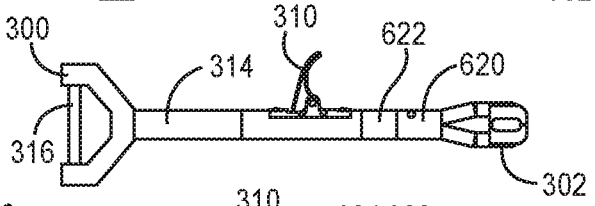

FIGS. 6C and 7C show a release aid 300 with a first lengthening member 620 and a second lengthening member 622.

Figure 7D:
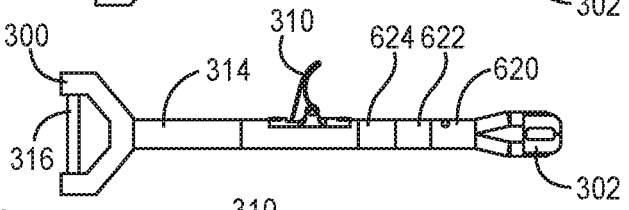

FIGS. 6D and 7D show a release aid 300 with a first lengthening member 620, a second lengthening member 622, and a third lengthening member 624.

Figure 7E:
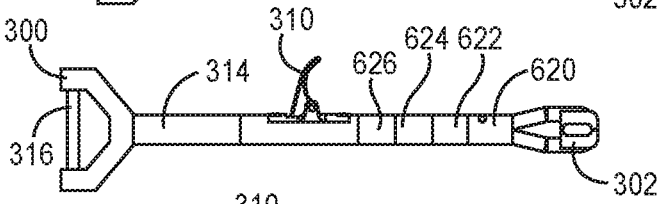

FIGS. 6E and 7E show a release aid 300 with a first lengthening member 620, a second lengthening member 622, a third lengthening member 624, and a fourth lengthening member 626.

Figure 7F:
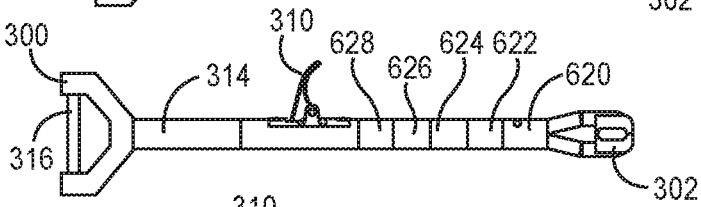

FIGS. 6F and 7F show a release aid 300 with a first lengthening member 620, a second lengthening member 622, a third lengthening member 624, a fourth lengthening member 626, and a fifth lengthening member 628.

Figure 7G:
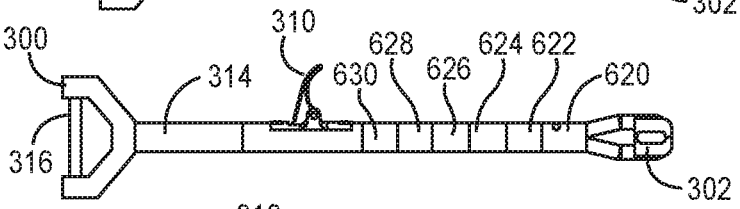

FIGS. 6G and 7G show a release aid 300 with a first lengthening member 620, a second lengthening member 622, a third lengthening member 624, a fourth lengthening member 626, a fifth lengthening member 628, and a sixth lengthening member 630.

Figure 7H:
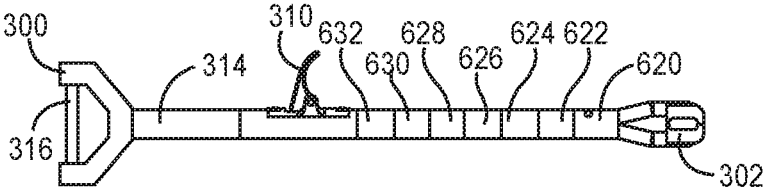

FIGS. 6H and 7H show a release aid 300 with a first lengthening member 620, a second lengthening member 622, a third lengthening member 624, a fourth lengthening member 626, a fifth lengthening member 628, a sixth lengthening member 630, and a seventh lengthening member 632.

In an embodiment, each lengthening member can include a male end and a female end, such that the lengthening member can be coupled to an adjacent lengthening member, the trigger, or the grasping element. In some embodiments, each lengthening member can have at least two portions, such as an internal shaft and an external housing. The internal shaft can form a portion of the linkage between the trigger and the grasping element, such that when the trigger is activated the grasping element can open or close. In some embodiments, the internal shaft can move with respect to the external housing.

Figures 8A, 8B, 8C, 8D, 8E:
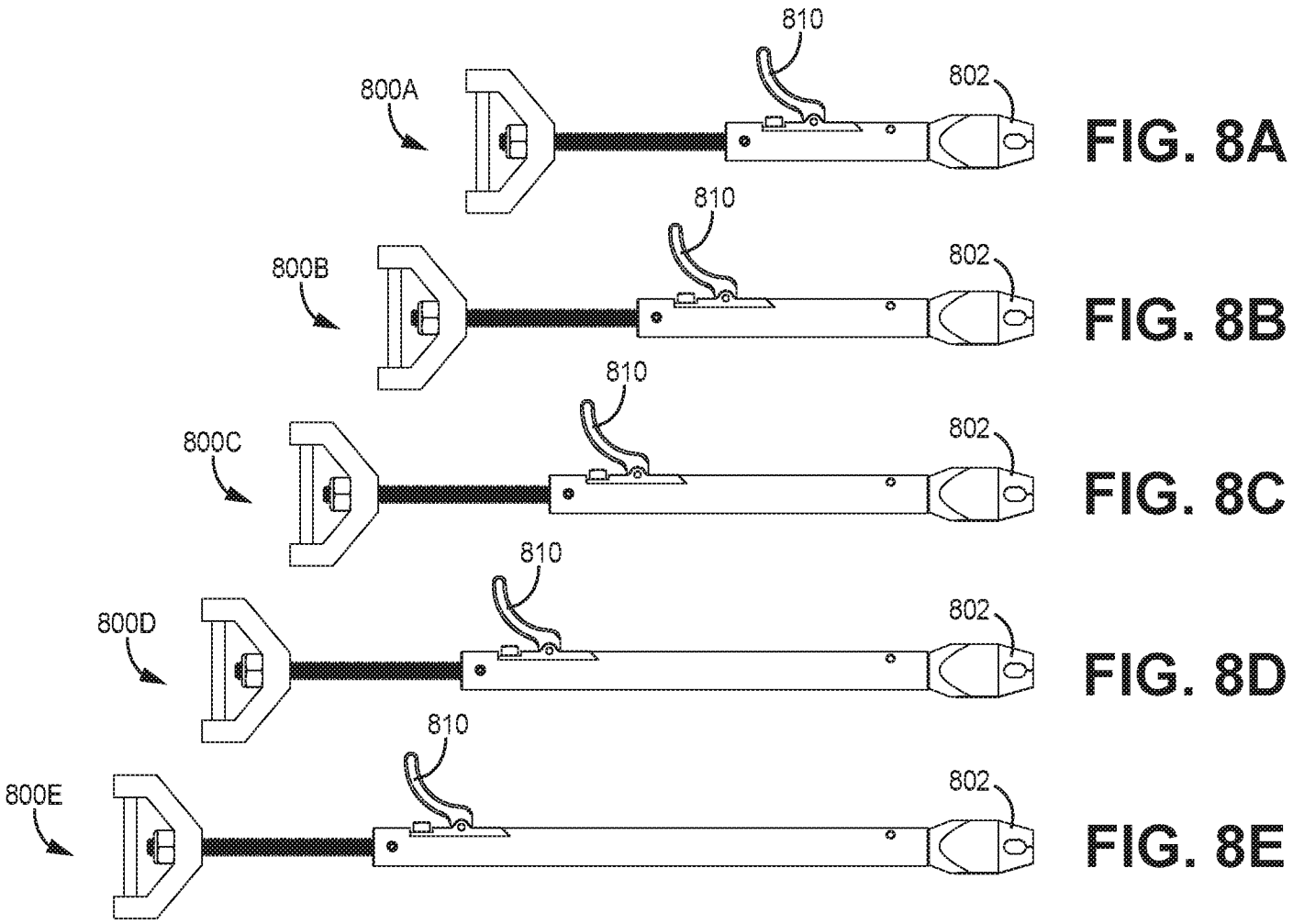
FIGS. 8A-E are side views of a release aid triggered with an archer's finger, according to an embodiment.

Together FIGS. 8A-8E show a system of a plurality of release aids. FIG. 8A shows release aid 800A. FIG. 8B shows release aid 800B. FIG. 8C shows release aid 800C. FIG. 8D shows release aid 800D. FIG. 8E shows release aid 800E. The plurality of release aids 800A-E can be included in a system or a set of release aids.

In an embodiment, the system can include two or more release aids. In an embodiment, the system can include three, four, five, six, seven, eight, nine, or ten release aids. Other embodiments of the system can include more than ten release aids.

In various embodiments, all of the release aids that are included in the system are substantially identical except for the overall length and the distance between the trigger and the grasping element. In an embodiment, the distance from the fixed end to the trigger the same for all of the release aids in the system with the exception of machining tolerances. The release aids can be substantially identical in that their method of operation is the same and their size is the same (except for the overall distance and the distance between the trigger and the grasping element). In some embodiments, the substantially identical release aids can have different colors from each other or other non-operational differences. These differences can assist with distinguishing between the release aids but do not affect how the release aid operates as a release aid.

In some embodiments, each of the release aids in the plurality of release aids can differ in length. In an embodiment, each of the release aids is at least 1 cm (0.4 in) shorter or longer than each of the other release aids. For example, release aid 800C can be at least 1 cm (0.4 in) longer than release aid 800B, and release aid 800C can be at least 1 cm (0.4 in) shorter than release aid 800D. In another embodiment, each of the release aids is at least 2 cm (0.8 in) shorter or longer than each of the other release aids.

Figure 9:
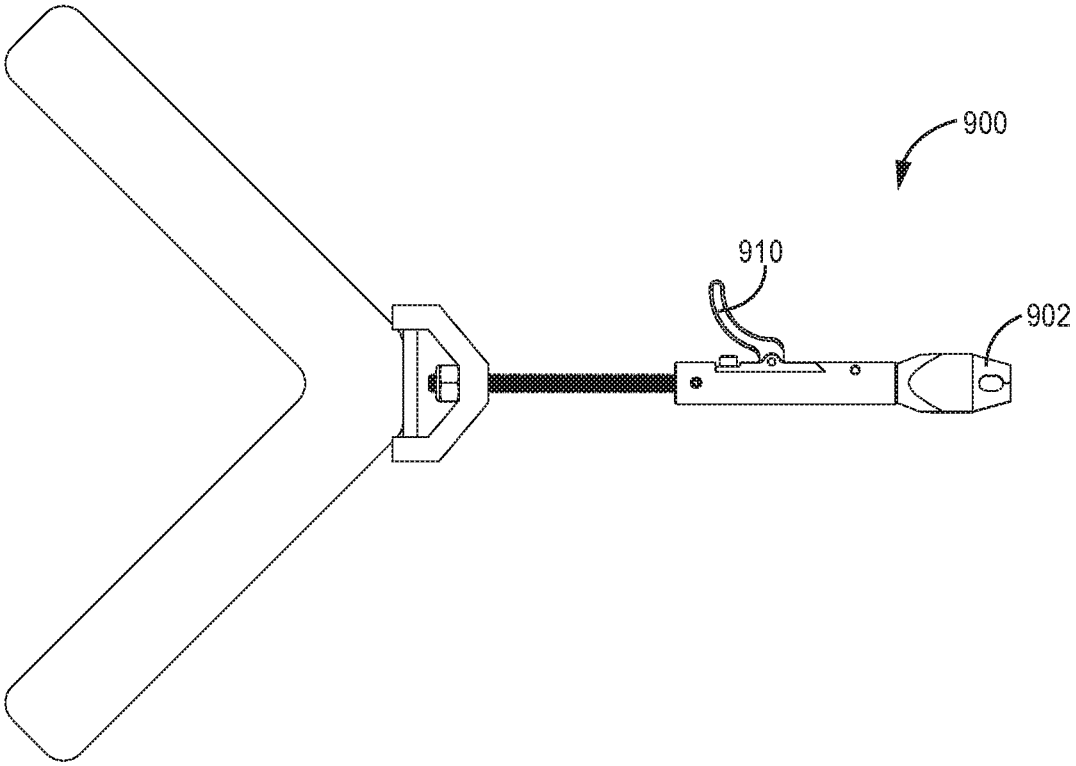
FIG. 9 shows a side view of a release aid triggered with an archer's finger, according to an embodiment.

FIG. 9 shows a selected release aid 900. The selected release aid 900 can have a desired length from the trigger 910 to the grasping element 902, such as to compensate for the difference between the archer's draw length and the bow's draw length. Because of use of the release aid, an archer can shoot a bow with a draw length that is less than the archer's draw length. Because of the use of such a release aid, an archer can shoot a bow that is more compact than a bow with a draw length that matches the archer's draw length.

Figure 10:
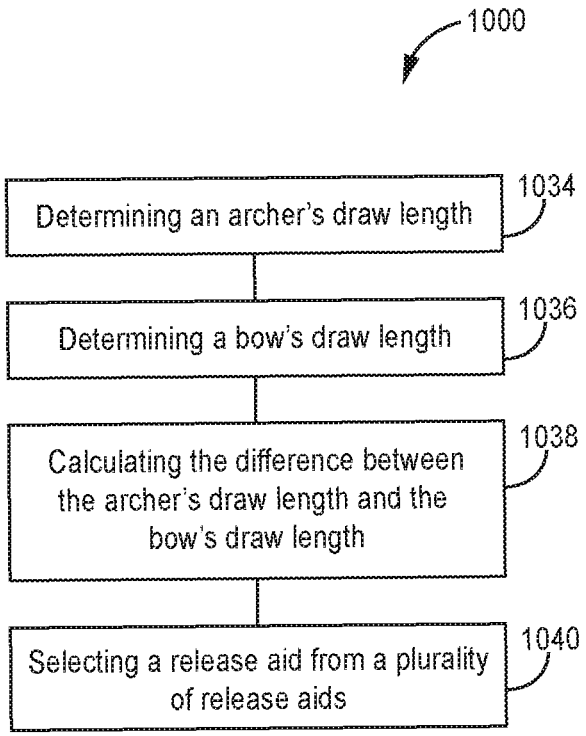
FIG. 10 shows a flow chart depicting a method of selecting a release aid for an archer, according to an embodiment.

FIG. 10 shows a flow chart depicting a method 1000 of selecting a release aid for an archer for use with a bow that has a draw length that is less than the archer's draw length, according to an embodiment. The method 1000 can include determining an archer's draw length 1034. The archer's draw length can be determined through numerous different methods, such as measuring, estimating, or through trial and error.

The method 1000 can include determining the bow's draw length 1036 which is less than the archer's draw length. The bow's draw length can be determined through numerous different methods, such as measuring or reading a description about the bow.

The method 1000 can include calculating a difference between the archer's draw length and the bow's draw length 1038. The difference can be calculated by subtracting the archer's draw length from the bow's draw length.

The method 1000 can include selecting a release aid from a plurality of release aids 1040. The selection of a release aid can be based on the difference between the archer's draw length and the bow's draw length, such as to compensate for the difference between the two draw lengths with a release aid. The release aid can have a desired length between the trigger and the grasping element to make up for or compensate for the difference in draw lengths. The plurality of release aids can include two or more release aids, such as three, four, or five release aids. The release aids that are included in the plurality of release aids can have different distances between the trigger element and their grasping element.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this technology pertains. All publications and patent applications are herein incorporated by reference to the same extent as if each individual publication or patent application was specifically and individually indicated by reference.

The technology has been described with reference to various specific and preferred embodiments and techniques. However, it should be understood that many variations and modifications may be made while remaining within the spirit and scope of the technology.

The invention claimed is:

1. A release aid for an archery bow, comprising:

a fixed end configured to be fixed relative to an archer;

a grasping element configured to grasp and release a drawstring; and a trigger element disposed between the fixed end and the grasping element, wherein the trigger element is linked to the grasping element, wherein when the grasping element is retaining the drawstring and the trigger element is activated the grasping element releases the drawing;

wherein a distance between the trigger element and the grasping element is at least 5 cm and not more than 25 cm.

2. The release aid for an archery bow according to claim 1, further comprising a first shaft extending from the trigger element to the grasping element.

3. The release aid for an archery bow according to claim 2, wherein the first shaft is configured to be removed and replaced with a second shaft, wherein the second shaft has a different length from the first shaft.

4. The release aid for an archery bow according to claim 1, wherein the fixed end is configured to be gripped by an archer's hand.

5. The release aid for an archery bow according to claim 1, wherein the fixed end comprises a coupling element, wherein the coupling element is configured to couple the release aid to the archer.

6. The release aid for an archery bow according to claim 5, wherein the coupling element is a strap.

7. The release aid for an archery bow according to claim 1, wherein the trigger element is activated by an archer's thumb.

8. The release aid for an archery bow according to claim 1, wherein the trigger element is activated by an archer's index finger or middle finger.

9. A system of archery release aids, comprising:

a first release aid for an archery bow, comprising a first fixed end configured to be fixed relative to the archer;

a first grasping element configured to grasp and release a drawstring; and a first trigger element disposed between the first fixed end and the first grasping element, wherein the first trigger element is linked to the first grasping element, wherein when the first trigger element is activated the first grasping element releases the drawstring;

a second release aid for an archery bow, comprising:

a second fixed end configured to be fixed relative to the archer;

a second grasping element configured to grasp and release a drawstring; and a second trigger element disposed between the second fixed end and the second grasping element, wherein the second trigger element is linked to the second grasping element, wherein when the second trigger element is activated the second grasping element releases the drawstring;

wherein distance between the first trigger element and the first grasping element is at least 1 cm longer than the distance between the second trigger element and the second grasping element.

10. The system of archery release aids according to claim 9, wherein the first release aid is substantially identical to the second release aid except that the distance between the first trigger element and the first grasping element is different than the distance between the second trigger element and the second grasping element.

11. The system of archery release aids according to claim 9, wherein the distance between the first trigger element and the first grasping element and the distance between the second trigger element and the second grasping element are both at least 5 cm and not greater than 25 cm.

12. The system of archery release aids according to claim 9, wherein the first trigger element and the second trigger element are both configured to be activated by an archer's thumb.

13. The system of archery release aids according to claim 9, the first trigger element and the second trigger element are both configured to be activated by an archer's index finger or middle finger.

14. The system of archery release aids according to claim 9, further comprising a third release aid for an archery bow, wherein the third release aid, comprises a third fixed end configured to be fixed relative to the archer;

a third grasping element configured to grasp and release a drawstring; and a third trigger element disposed between the third fixed end and the third grasping element, wherein the third trigger element is linked to the third grasping element, wherein when the third trigger element is activated the third grasping element releases the drawstring;

wherein distance between the second trigger element and the second grasping element is at least 1 cm longer than the distance between the third trigger element and the third grasping element.

15. The system of archery release aids according to claim 14, wherein the distance between the first trigger element and the first grasping element, the distance between the second trigger element and the second grasping element, and the distance between the third trigger element and the third grasping element are all at least 5 cm and not greater than 25 cm.

16. The system of archery release aids of claim 14, wherein the third release aid is substantially identical to the first release aid and the second release aid except for the overall lengths of the release aids and the distances between the trigger elements and the grasping elements.

17. A method for selecting an archery release aid, comprising:

determining an archer's draw length;

determining a selected bow's draw length;

calculating a difference between the archer's draw length and the bow's draw length; and selecting a release aid from a plurality of release aids based on the difference between the archer's draw length and the bow's draw length;

wherein the plurality of release aids includes two or more release aids;

wherein each of the release aids that are included in the plurality of release aids comprises a trigger element and a grasping element;

wherein each of the release aids that are included in the plurality of release aids has a different length from the trigger element to the grasping element.

18. The method for selecting an archery release aid according to claim 17, wherein each of the release aids included in the plurality of release aids are substantially identical except for the length from the trigger element to the grasping element.

19. The method for selecting an archery release aid according to claim 17, wherein each release aid has a distance from its trigger element to its grasping element that differs from all of the other release aids by at least 1 cm.

20. The method for selecting an archery release aid according to claim 17, wherein all of the release aids included in the plurality of release aids have a distance from the trigger to the grasping element of at least 5 cm and not more than 25 cm.

21. The method for selecting an archery release aid according to claim 17, wherein each trigger element for each of the release aids included in the plurality of release aids is configured to be activated by an archer's thumb, or each trigger element for each of the release aids included in the plurality of release aids is configured to be activated by an archer's index finger or middle finger.

22. The method of archery release aids of claim 17, wherein the plurality of release aids includes three or more release aids.

23. The method of archery release aids of claim 22, wherein each of the release aids included in the plurality of release aids are substantially identical except for the length from the trigger element to the grasping element.

* * * * *